US011205376B2

(12) United States Patent
Chu et al.

(10) Patent No.: US 11,205,376 B2
(45) Date of Patent: Dec. 21, 2021

(54) DISPLAY COMPENSATION METHOD, DISPLAY COMPENSATION DEVICE, DISPLAY DEVICE AND STORAGE MEDIUM

(71) Applicant: BOE TECHNOLOGY GROUP CO., LTD., Beijing (CN)

(72) Inventors: Mingi Chu, Beijing (CN); Lirong Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 58 days.

(21) Appl. No.: 16/630,996

(22) PCT Filed: Mar. 6, 2019

(86) PCT No.: PCT/CN2019/077201
§ 371 (c)(1),
(2) Date: Jan. 14, 2020

(87) PCT Pub. No.: WO2020/177103
PCT Pub. Date: Sep. 10, 2020

(65) Prior Publication Data
US 2021/0225274 A1 Jul. 22, 2021

(51) Int. Cl.
*G09G 3/3225* (2016.01)
*G09G 3/3275* (2016.01)

(52) U.S. Cl.
CPC ..... *G09G 3/3225* (2013.01); *G09G 3/3275* (2013.01); *G09G 2320/0242* (2013.01); *G09G 2360/142* (2013.01); *G09G 2360/148* (2013.01)

(58) Field of Classification Search
CPC ..... G09G 3/3233; G09G 2300/0819; G09G 2320/043; G09G 2320/0233; G09G 3/30; G09G 3/3208; G09G 3/3225; G09G 3/3275; G09G 2360/142; G09G 2360/148; G09G 2320/0242; G09G 2320/046; G09F 2340/00
USPC ..... 345/76
See application file for complete search history.

(56) References Cited

U.S. PATENT DOCUMENTS

2006/0132396 A1* 6/2006 Yui ..... G09G 3/22 345/75.2
2009/0135114 A1 5/2009 White et al.
2015/0379922 A1 12/2015 Zhang
2017/0132973 A1* 5/2017 Tsuchida ..... G09G 3/3233

FOREIGN PATENT DOCUMENTS

CN 101878499 A 11/2010
CN 104021761 A 9/2014
CN 105989201 A 10/2016
KR 20120135657 A 12/2012

* cited by examiner

*Primary Examiner* — Koosha Sharifi-Tafreshi
(74) *Attorney, Agent, or Firm* — Dilworth & Barrese, LLP; Michael J. Musella, Esq.

(57) ABSTRACT

A display compensation method for a display panel, a display compensation device, a display device and a storage medium. The display compensation method includes: acquiring compensation data of i pixels adjacent to the target pixel of the display panel respectively; deleting deviation data from the compensation data of i pixels; calculating the compensation data of the target pixel according to the remaining compensation data; i is an integer greater than 2.

19 Claims, 9 Drawing Sheets

DISPLAY COMPENSATION METHOD, DISPLAY COMPENSATION DEVICE, DISPLAY DEVICE AND STORAGE MEDIUM

TECHNICAL FIELD

Embodiments of the present disclosure relate to a display compensation method, a display compensation device, a display device, and a storage medium.

BACKGROUND

As a current-type light emitting device, an electroluminescent element has been widely used in display panels. Since the electroluminescent element has a self-luminous property, the electroluminescent display panel does not require a backlight. And since the electroluminescent display panel has the advantages of high contrast, thin thickness, wide viewing angle, fast response speed, flexibility, and simple construction and manufacturing process, the electroluminescent display panel has gradually become the next generation of mainstream display panel.

SUMMARY

At least one embodiment of the present disclosure provides a display compensation method for a display panel, including: acquiring compensation data of i pixels adjacent to a target pixel of the display panel; deleting deviation data in the compensation data of the i pixels; calculating the compensation data of the target pixel according to the respective remaining compensation data; i is an integer greater than 2.

For example, in a display compensation method provided by an embodiment of the present disclosure, the i pixels include: a plurality of first pixels including a sensing element and a plurality of second pixels including no sensing element.

For example, in the display compensation method provided by an embodiment of the present disclosure, deleting the deviation data in the compensation data of the i pixels includes: deleting the maximum value and the minimum value in the compensation data of the i pixels.

For example, in the display compensation method provided by an embodiment of the present disclosure, calculating the compensation data of the target pixel according to the respective remaining compensation data includes: acquiring at least two intermediate values of the respective remaining compensation data; and calculating an average value of the at least two intermediate values as the compensation data of the target pixel.

For example, in the display compensation method provided by an embodiment of the present disclosure, calculating the compensation data of the target pixel according to the respective remaining compensation data includes: acquiring gains of the respective remaining compensation data respectively; and acquiring the compensation data of the target pixel based on the respective remaining compensation data and the gains thereof.

For example, in the display compensation method provided by an embodiment of the present disclosure, the pixels corresponding to the respective remaining compensation data include: a plurality of first pixels including a sensing element and a plurality of second pixels including no sensing element, the absolute value of the gain of the compensation data of the first pixel is greater than the absolute value of the gain of the compensation data of the second pixel.

For example, in a display compensation method provided by an embodiment of the present disclosure, acquiring compensation data of i pixels adjacent to a target pixel of the display panel includes: acquiring compensation data of the first pixel; determining compensation data of the second pixel according to the compensation data of the first pixel.

For example, in a display compensation method provided by an embodiment of the present disclosure, the compensation data of the second pixel is equal to the compensation data of the first pixel adjacent thereto, or equal to the average value of the compensation data of two first pixels adjacent thereto.

For example, in a display compensation method provided by an embodiment of the present disclosure, the compensation data of the first pixel is acquired by the sensing element in a time division manner.

For example, in a display compensation method provided by an embodiment of the present disclosure, the display panel includes a plurality of pixels arranged in an array, the plurality of pixels include: a plurality of first pixels including a sensing element and a plurality of second pixels including no sensing element, the plurality of pixels are configured to display multiple colors, and acquiring the compensation data of the first pixel through the sensing element in a time division manner includes: driving sequentially all pixels corresponding to respective color respectively, and acquiring sequentially the compensation data of the first pixels corresponding to the respective color by the sensing element.

For example, in a display compensation method provided by an embodiment of the present disclosure, the compensation data includes a sensing value or a compensation value.

At least one embodiment of the present disclosure further provides a display compensation device, including: an acquiring unit configured to acquire compensation data of i pixels adjacent to a target pixel of the display panel; a data selection unit configured to delete deviation data in the compensation data of the i pixels; a calculation unit configured to calculate the compensation data of the target pixel according to the respective remaining compensation data; i is an integer greater than 2.

At least one embodiment of the present disclosure further provides a display compensation device, including: a processor; a memory storing one or more computer program modules, the one or more computer program modules being stored in the memory and configured to be executed by the processor, the one or more computer program modules include instructions for executing a display compensation method provided by any embodiment of the present disclosure.

At least one embodiment of the present disclosure also provides a display panel including a display compensation device provided by any embodiment of the present disclosure.

At least one embodiment of the present disclosure also provides a display device including a display panel provided by any embodiment of the present disclosure.

For example, in the display device provided by an embodiment of the present disclosure, the display panel includes a plurality of pixels arranged in an array, and the plurality of pixels includes: a plurality of first pixels including a sensing element and a plurality of second pixels including no sensing element, the first pixels and the second pixels are arranged in a row-vertical staggered arrangement, a row staggered arrangement, or a column staggered arrangement.

For example, in the display device provided by an embodiment of the present disclosure, the sensing elements of at least two columns of the first pixels are connected via a sensing line.

For example, in the display device provided by an embodiment of the present disclosure, the sensing element is a photodiode or a phototransistor.

At least one embodiment of the present disclosure also provides a storage medium that non-transitorily stores computer-readable instructions, and when the non-transitorily stored computer-readable instructions are executed by a computer, instructions for executing a display compensation method provided by any embodiment of the present disclosure can be executed.

BRIEF DESCRIPTION OF THE DRAWINGS

In order to more clearly illustrate the technical solutions of the embodiments of the present disclosure, the drawings of the embodiments will be briefly introduced below. Obviously, the drawings in the following description only relate to some embodiments of the present disclosure, rather than limiting the present disclosure.

DETAILED DESCRIPTION OF THE EMBODIMENTS

Figure 1:
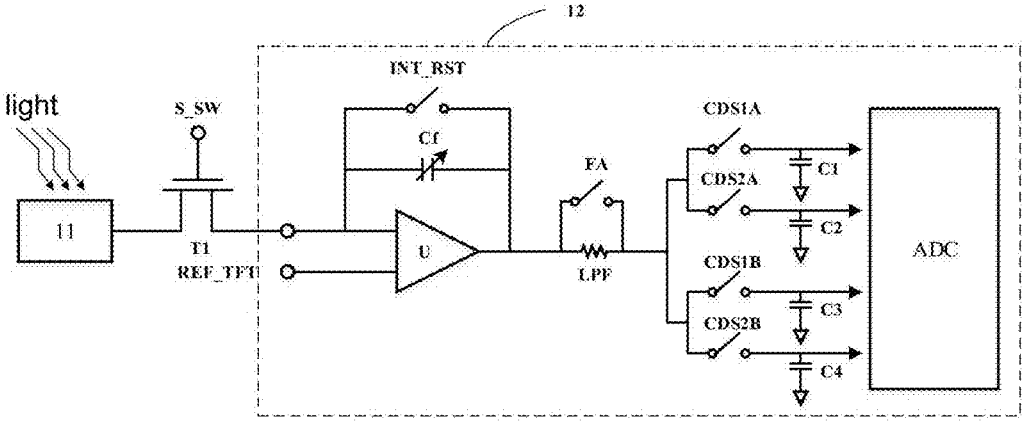
FIG. 1 is a light sensing circuit.

To make the objectives, technical solutions, and advantages of the embodiments of the present disclosure more clear, the technical solutions of the embodiments of the present disclosure will be described clearly and completely in combination with the drawings of the embodiments of the present disclosure. Obviously, the described embodiments are part of embodiments of the present disclosure, but not all the embodiments. Based on the described embodiments of the present disclosure, all other embodiments obtained by a person of ordinary skill in the art without creative labor shall fall within the protection scope of the present disclosure.

Unless defined otherwise, the technical terms or scientific terms used in the present disclosure shall have the ordinary meanings understood by a person of ordinary skill in the art to which the present disclosure belongs. The terms "first", "second", and the like used in this disclosure do not indicate any order, quantity, or importance, but are only adopted to distinguish different components. Similarly, "a", "an", or "the" and the like do not indicate a limit on quantity, but rather indicate that there is at least one. Words such as "including" or "comprising" mean that the element or item appearing before the word encompasses the element or item appearing after the word and its equivalent without excluding other elements or items. Words such as "connected" or "coupled" are not limited to physical or mechanical connections, but may include electrical connections, whether direct or indirect. "Up", "down", "left", "right", etc. are only adopted to indicate the relative position relationship. When the absolute position of the described object changes, the relative position relationship may also change accordingly.

The disclosure is described below through several specific embodiments. In order to keep the following description of the embodiments of the present disclosure clear and concise, detailed descriptions of known functions and known components may be omitted. When any component of an embodiment of the present disclosure appears in more than one drawing, the component is represented by the same or similar reference numeral in each drawing.

Generally, a pixel circuit includes a light emitting device (for example, an OLED (Organic Light-Emitting Diode)), a thin film transistor (Thin Film Transistor, TFT), a storage capacitor, and the like. For example, during the display process, the pixel circuit can control whether the TFT is turned on or off by a fixed gate scan signal, so as to charge a voltage corresponding to the display data to a storage capacitor and control the display of the display unit by the magnitude of the voltage, and then the light emission brightness of the display unit is adjusted.

For a long time, the process stability of TFT is the main factor affecting the display picture of the display screen. Due to the deviation in the manufacturing process of the TFT, the threshold voltage Vth and mobility of each driving TFT in a plurality of pixel circuits are different in characteristics, thereby causing brightness deviation among respective pixels, resulting in a decrease in the brightness uniformity of the display screen, and even spots or patterns on a region. On the other hand, light-emitting devices made of organic materials will gradually deteriorate over time and cannot be recovered, and light-emitting devices in the regions that have been lit for a long time will deteriorate faster, resulting in a after-image on the display picture. Therefore, in order to solve the technical problems regarding brightness uniformity and afterimage in the display device, in addition to improving the process of the thin film transistor, people have also proposed compensation technologies, for example, comprising pixel compensation (ie., internal compensation) and external compensation.

Since pixel compensation cannot meet all backplane technologies, it needs to be improved through external compensation. At present, large-sized display panels usually compensate pixel circuits by combining electrical compensation and optical compensation. This method can integrate the advantages of electrical compensation and optical compensation to improve the uniformity of the display panel. In general, electrical compensation can determine the compensation data by sensing the voltage or current of the pixel circuit acquired by the sensing signal line to compensate the characteristics of the driving TFT (for example, threshold voltage and mobility, etc.); optical compensation can compensate the display uniformity of the panel as a whole. Because optical compensation performs an optical correction in an optical manner, it can effectively compensate for display problems caused by various reasons, such as the Mura phenomenon generated in the device manufacturing process.

FIG. 1 is a light sensing circuit. As shown in FIG. 1, the light sensing circuit includes a sensing element 11, a first transistor T1 and a detection circuit 12. For example, the detection circuit 12 includes an operational amplifier U, a first switch INT_RST, a second switch FA, third to sixth switches CDS1A-CDS2B, and first to fourth capacitors C1-C4, an inductor LPF, a feedback capacitor Cf, and an analog digital converter ADC and so on. For example, after the sensing element 11 senses the light emitted by the light emitting device in the pixel circuit, it generates a corresponding electrical signal, such as a current signal, through photoelectric conversion. The current signal can be read by a current integrator (not shown in the figure), so that the current light amount can be translated based on the magnitude of the current signal. For example, the first transistor T1 is turned on under the control of the optical detection start signal S_SW, and the generated current is transferred to the detection circuit 12 for detection. The detection circuit 12 can acquire the sensing data of the pixel circuit, thereby completing the optical sensing. The sensing data is further processed by a related algorithm to obtain an optical compensation value, and then during the normal light-emitting stage of the pixel circuit, the optical compensation value obtained by the algorithm is superimposed on the input display data to obtain the compensated display data, thereby achieving optical compensation.

However, the above external compensation method can only perform initial compensation optimization and cannot effectively perform real-time compensation for the aging of the light emitting device. Therefore, as the service time of the light emitting device increases, the uniformity of the display panel will begin to decline, and some display problems such as afterimages may appear, which severely affect the use experience.

Figure 2:
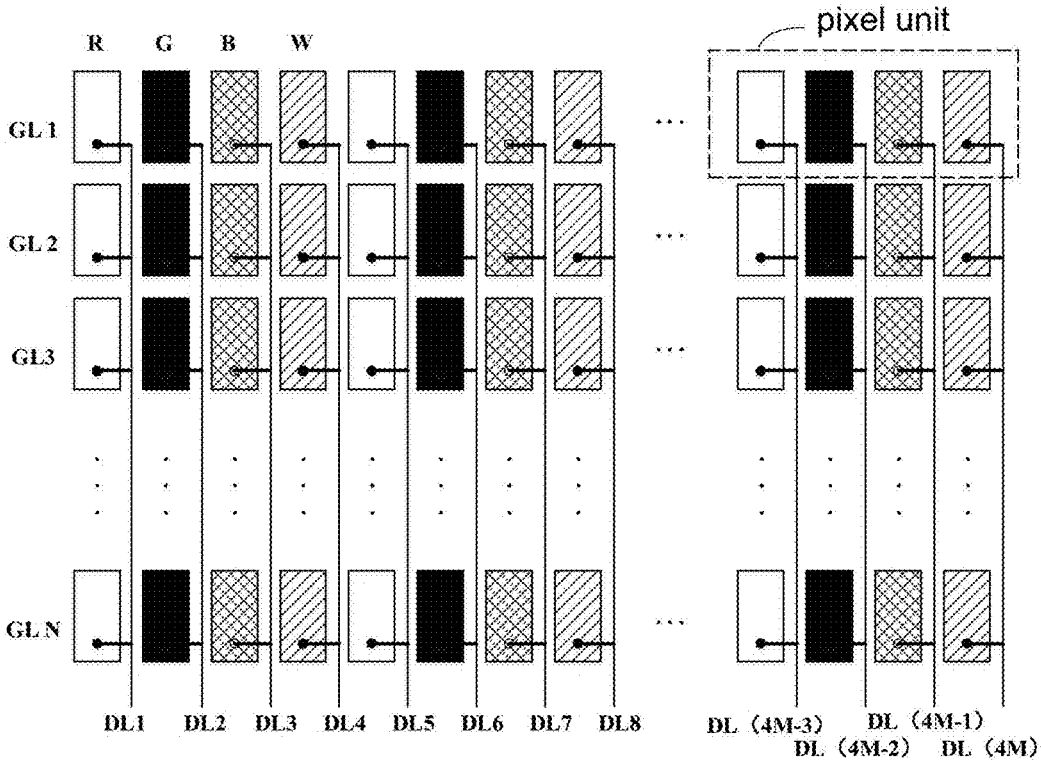
FIG. 2 is a schematic diagram of a display pixel arrangement.

On the other hand, the above-mentioned external compensation method requires compensation with respect to each pixel. FIG. 2 is a schematic diagram of a display pixel arrangement. As shown in FIG. 2, taking a large-sized OLED display panel as an example, the display panel includes N rows and M columns (M and N are both integers greater than 1) of the pixel unit 13. For example, each pixel unit 13 includes a four-color pixel arrangement, which is a red pixel R, a green pixel G, a blue pixel B, and a white pixel W in sequence. For example, N rows of pixels are connected one-to-one with N gate lines GL1-GLN, and 4M columns of pixels are connected one-to-one with 4M data lines DL1-DL(4M). It should be noted that, for the sake of clarity and conciseness, only the numbers of the gate lines are shown in FIG. 2, and the specific connection lines are omitted, and the following embodiments are the same and will not be repeated.

Figure 3:
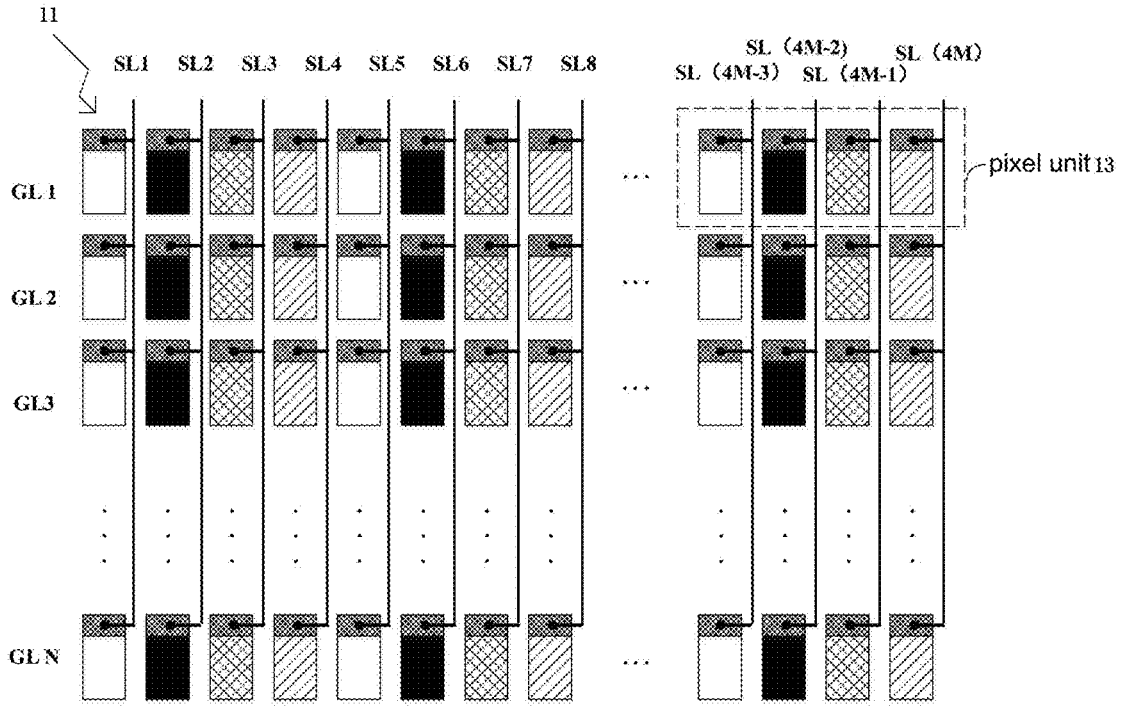
FIG. 3 is a schematic diagram of integration of a display pixel and a sensing element.

FIG. 3 is a schematic diagram of integration of a display pixel and a sensing element. In order to compensate each pixel, as shown in FIG. 3, each pixel includes a sensing element 11. For example, the sensing element 11 may be disposed above or around the pixel to sense the amount of light of each pixel. For example, the sensing elements 11 of the 4M columns of pixels are connected one-to-one with the 4M sensing lines SL1-SL(4M) respectively, so that the amount of light sensed by the sensing elements 11 of each pixel is transmitted through the corresponding sensing lines to the light sensing circuit described in FIG. 1, and is subjected to a corresponding algorithm to obtain a compensation value.

However, this method needs to store the compensation data of all pixels, which takes up a large storage space, and the hardware facilities and drivers required to implement this method will be more complicated, so it is not conducive to mass production of display panels.

An embodiment of the present disclosure provides a display compensation method for a display panel, including respectively acquiring compensation data of i (i is an integer greater than 2) pixels adjacent to a target pixel of the display panel; deleting deviation data in the compensation data of the i pixels; and calculating the compensation data of the target pixel according to the respective remaining compensation data.

At least one embodiment of the present disclosure also provides a display compensation device, a display device, and a storage medium corresponding to the display compensation method described above.

The display compensation method provided by the above embodiments of the present disclosure can sense and compensate the optical data of respective pixel of the display panel in real time, save the storage space of the display panel, avoid the display picture abnormality, etc. caused by the aging of the light emitting device, and improve display uniformity of the display panel.

The embodiments of the present disclosure and examples thereof will be described in detail below with reference to the drawings.

Figure 4A:
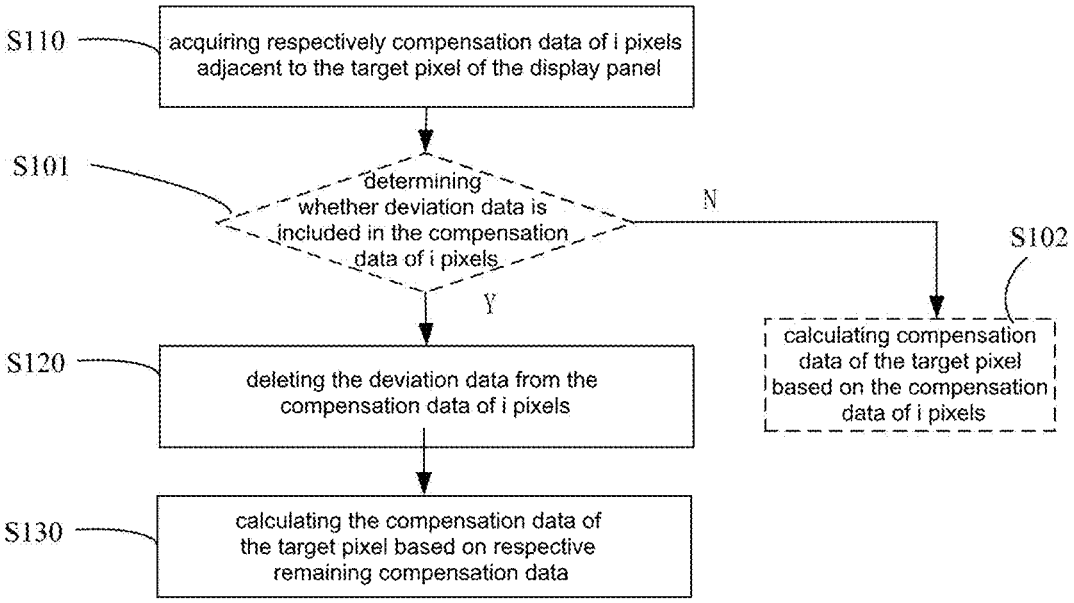
FIG. 4A is a flowchart of a display compensation method for a display panel provided by some embodiments of the present disclosure.

FIG. 4A is a flowchart of a display compensation method for a display panel according to some embodiments of the present disclosure. The display compensation method may be implemented in software, hardware, firmware, or any combination thereof, and loaded and executed by a processor in the display panel.

For example, the display panel includes a plurality of pixels arranged in an array, for example, including N rows and 4M columns of pixels as shown in FIG. 2, and the plurality of pixels includes: a plurality of first pixels including a sensing element and a plurality of second pixels including no sensing element. For example, the display compensation method may be configured to sense the optical characteristics of the light-emitting element in the first pixel in real time through the sensing element, and use a plurality of pixels adjacent to the second pixel (for example, the plurality of pixels include a first pixel and a second pixel) to calculate in real time the optical characteristics of the second pixel (for example, a sensing value or a compensation value), so as to sense and compensate the optical data of respective pixel of the display panel in real time based on the obtained optical characteristics of respective pixel, save the storage space of the display panel, avoid the display picture abnormality, etc. caused by the aging of the light emitting device, and improve display uniformity of the display panel.

Hereinafter, a display compensation method according to some embodiments of the present disclosure will be described with reference to FIG. 4A. As shown in FIG. 4A, the display compensation method includes steps S110 to S130.

Step S110: The compensation data of i (i is an integer greater than 2) pixels adjacent to the target pixel of the display panel is acquired respectively.

Step S120: The deviation data in the compensation data of the i pixels is deleted.

Step S130: The compensation data of the target pixel is calculated according to the respective remaining compensation data.

For example, in the embodiment of the present disclosure, a pixel including a sensing element among a plurality of pixels of a display panel is referred to as a first pixel, and a pixel including no sensing element is referred to as a second pixel. The following embodiments are the same, which will not be described repeatedly. For example, with respect to the base substrate, the sensing element may be disposed above the pixels (so that they are at least partially overlapped) or around the pixels (so that they are not overlapped with each other) to sense the light amount of the corresponding pixels. For example, the display panel may be an OLED display panel, a quantum dot light emitting diode (PLED) display panel, or other types of display panels. The following description takes the OLED display panel as an example, but the embodiments of the present disclosure are not limited thereto.

For example, in the embodiment of the present disclosure, the sensing element may be an element such as a photodiode or a phototransistor, which is not limited in the embodiment of the present disclosure. For example, each pixel provided in the embodiment of the present disclosure may represent each sub-pixel in a display panel. The following embodiments are the same, which will not be described repeatedly.

For example, when i is equal to 1, that is, when compensation data of one pixel adjacent to the target pixel is acquired, the compensation data of the target pixel is the compensation data of the one pixel adjacent thereto. For example, when i is equal to 2, that is, when the number of pixels adjacent to the target pixel is 2, the compensation data of the target pixel may be an average value of the compensation data of the two pixels adjacent to the target pixel, which is not limited in the embodiment of the present disclosure.

For step S110, for example, the target pixel is a second pixel including no sensing element. Since the optical characteristics of the light-emitting elements in adjacent pixels are not significantly different, the compensation data of each target pixel including no sensing element can be determined from the compensation data of the pixels adjacent to the target pixel. Therefore, the display compensation method provided by some embodiments of the present disclosure may store only the compensation data of the first pixel, and the compensation data of the second pixel may be obtained in real time through the compensation data of the first pixel adjacent thereto, thereby saving the storage space of the driving device of the display panel, reducing the number of sensing elements and increasing the effective light-emitting area of the display panel. For example, the compensation data may be a sensing value of the pixel obtained by the light-sensitive sensing circuit shown in FIG. 1, or may be a compensation value obtained after the sensing value is processed by a related algorithm, which is not limited in the embodiment of the present disclosure.

For example, the number of pixels adjacent to the target pixel can be determined by the array arrangement of the pixels. For example, the pixels comprised in the (2m+1, 2n+1) array region centered on the target pixel may be configured to calculate the compensation data of the target pixel, where m and n are both integers greater than 1.

Figure 4B:
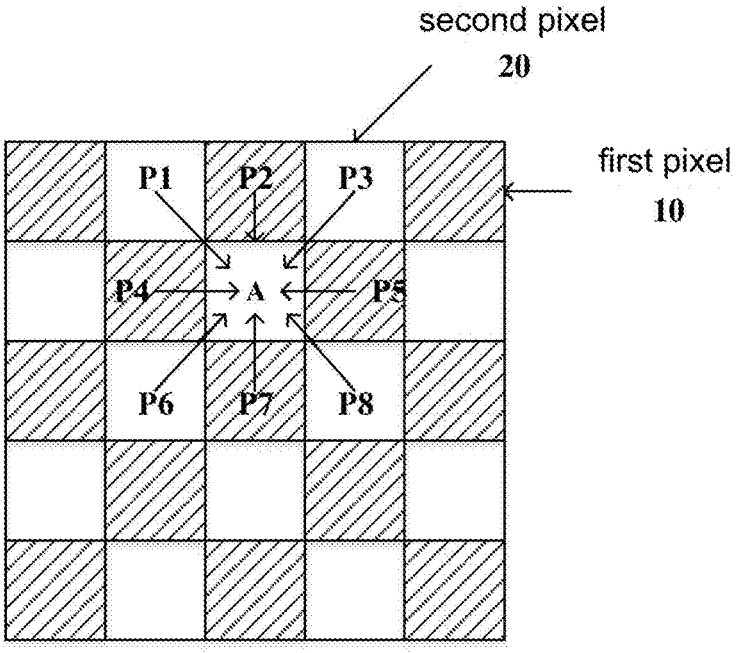
FIG. 4B is a schematic diagram of an example of a display compensation method provided by some embodiments of the present disclosure.
Figure 4C:
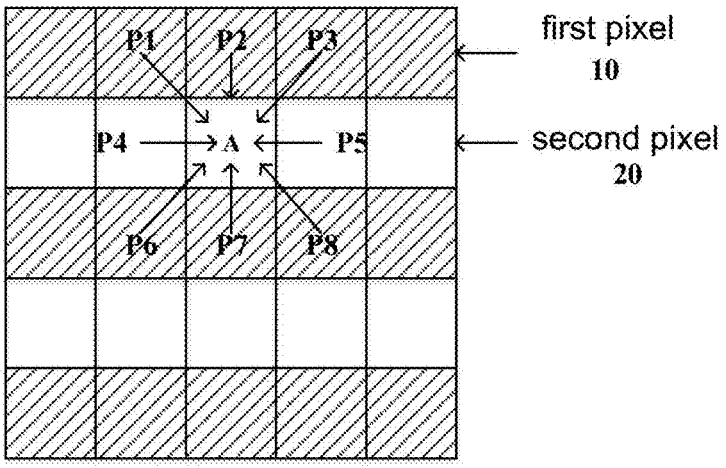
FIG. 4C is a schematic diagram of another example of a display compensation method provided by some embodiments of the present disclosure.

FIG. 4B is a schematic diagram of an example of a display compensation method provided by some embodiments of the present disclosure; FIG. 4C is a schematic diagram of another example of a display compensation method provided by some embodiments of the present disclosure. For example, as shown in FIG. 4B and FIG. 4C, the pixels included in the 3*3 array region centered on the target pixel A may be used to acquire the compensation data of the target pixel A, that is, m=n=1. It should be noted that the pixels in the larger array region such as 5*5 can also be used to acquire the compensation data of the target pixel A. At this time, the values of m and n can be determined according to specific conditions, or according to the arrangement manner of the pixel array (such as Δ arrangement, Real RGB arrangement, Pentile arrangement, etc.), which is not limited in the embodiment of the present disclosure.

For example, the i pixels adjacent to the target pixel of the display panel include a plurality of first pixels including a sensing element and a plurality of second pixels including no sensing element. For example, in the example shown in FIG. 4B, in the 3*3 array region centered on the target pixel A, among the i (i=8) pixels P1-P8 adjacent to the target pixel A, the pixels P2, P4, P5 and P7 represent the first pixels, and pixels P1, P3, P6, and P8 represent the second pixels. For example, in the example shown in FIG. 4C, among the i (i=8) pixels P1-P8 adjacent to the target pixel A, the pixels P1-P3 and P6-P8 represent the first pixels, and the pixels P4 and P5 represent the second pixels.

Figure 5:
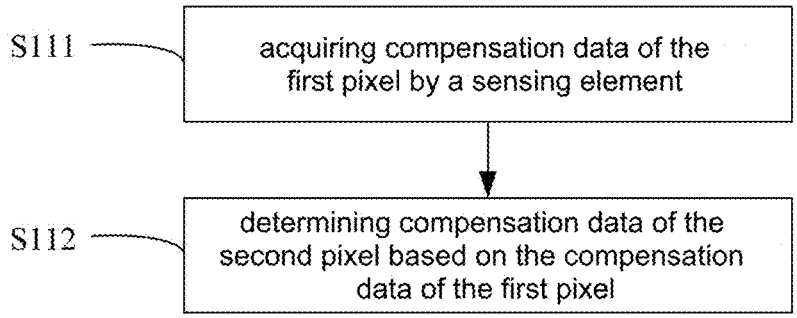
FIG. 5 is a flowchart of an example of step S110 shown in FIG. 4A.

FIG. 5 is a schematic diagram of acquiring compensation data of i pixels provided by some embodiments of the present disclosure. That is, FIG. 5 is an operation flowchart of an example of step S110 shown in FIG. 4A. For example, in the example shown in FIG. 5, the method for acquiring the compensation data of the i pixels includes steps S111 to S112. Hereinafter, a display compensation method according to an embodiment of the present disclosure will be described with reference to FIG. 5.

Step S111: Acquire the compensation data of the first pixel by the sensing element.

For example, the compensation data of the first pixels in the display panel that emit light of different colors may be acquired by the sensing element in a time division manner.

FIG. 11A-FIG. 11D are schematic diagrams of a display panel provided by some embodiments of the present disclosure. The display region of the display panel includes a plurality of pixels, the plurality of pixels further including a plurality of first pixels including a sensing element and a plurality of second pixels including no sensing element, and these first pixels and these second pixels are arranged in a row-vertical staggered arrangement, a row staggered arrangement, or a column staggered arrangement. For example, the first pixels include pixels that emit light of different colors, and the second pixels include pixels that emit light of different colors.

Figure 11A:
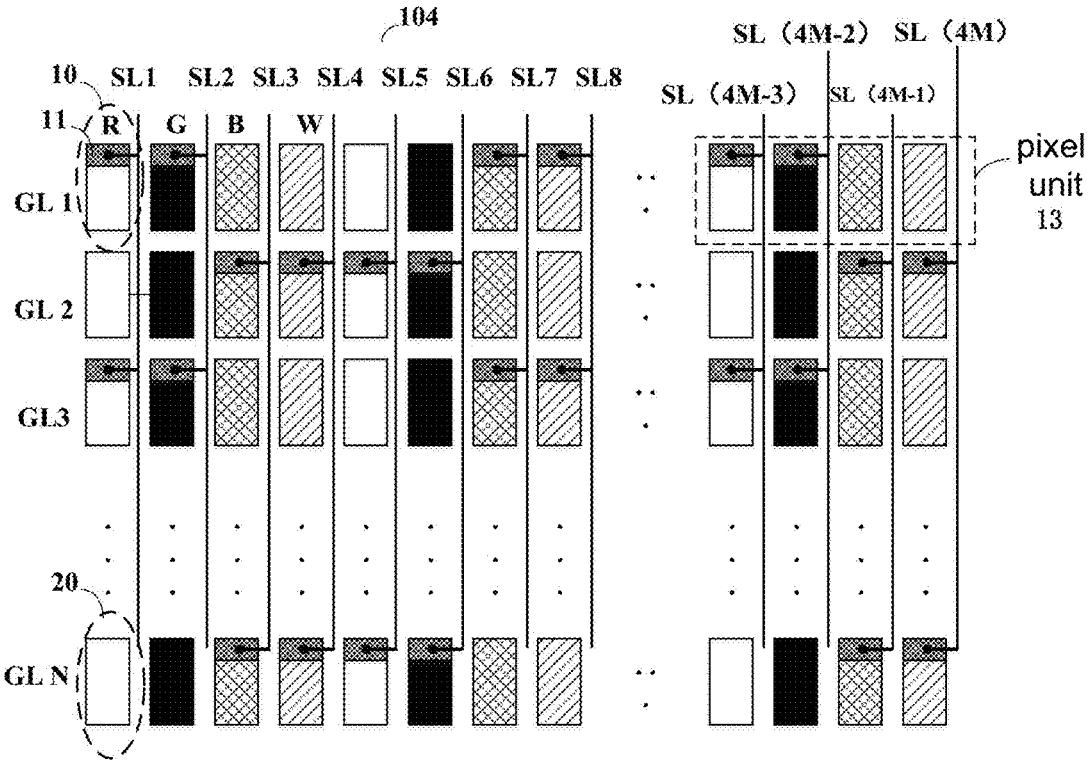
FIG. 11A is a schematic diagram of a display panel according to some embodiments of the present disclosure.

For example, as shown in FIG. 11A, the display panel 104 includes N rows and 4M columns of pixels, and the N rows and 4M columns of pixels include: a plurality of first pixels 10 including the sensing element 11 and a plurality of second pixels 20 including no sensing element. For example, the N rows and 4M columns of pixels include a four-color pixel arrangement, which is a red pixel R, a green pixel G, a blue pixel B, and a white pixel W in sequence, so that multiple colors can be displayed. The embodiment of the present disclosure does not limit the composition of each pixel unit. For example, each pixel unit may include a red pixel R, a green pixel G, and a blue pixel B but not a white pixel W. For another example, each pixel unit may include a red pixel R, green pixel G, blue pixel B, and yellow pixel Y.

For example, acquiring compensation data of a first pixel in a display panel that emits light of different colors by using a time division method through a sensing element includes: driving sequentially all pixels corresponding to respective color respectively, and acquiring sequentially the compensation data of the first pixels corresponding to the respective color by the sensing element.

In a specific example, when each group of pixel units is sensed, one color sub-pixel comprised therein (for example, one of red pixel R, green pixel G, blue pixel B, or white pixel W) is lit, and then the compensation data (sensing value or compensation value) of the first pixel in each sub-pixel of the color which is lit is extracted and stored in the storage unit. After the extraction and storage of the sensing value or compensation value of the first pixel of all the sub-pixels of this color are completed, all the sub-pixels of the next color are lit, and the same steps are repeated until the sensing values or the compensation values of the sub-pixels of all colors are acquired.

Step S112: Determine the compensation data of the second pixel according to the compensation data of the first pixel.

In order to determine the compensation data of the second pixel according to the compensation data of the first pixel, for example, the compensation data of the second pixel may be equal to the compensation data of the first pixel adjacent thereto, or may be the average value of the compensation data of two pixels adjacent thereto. The specific value of the average value of the compensation data may depend on the actual situation, which is not limited in the embodiments of the present disclosure.

For example, in the example shown in FIG. 4B, the compensation data of the second pixel P1 may be set to be equal to the compensation data of the first pixel P2 or the first pixel P4, and the compensation data of the second pixel P3 may be set to be equal to the compensation data of the first pixel P2 or the first pixel P5, the compensation data of the second pixel P6 may be set to be equal to the compensation data of the first pixel P4 or the first pixel P7, and the compensation data of the second pixel P8 may be set to be equal to the compensation data of the first pixel P5 or the first pixel P7.

For example, in the example shown in FIG. 4C, the compensation data of the second pixel P4 may be set to be equal to the compensation data of the first pixel P1 or the first pixel P6, or may be set to be equal to the average value of the first pixel P1 and the first pixel P6. The calculation method of the compensation data of the second pixel P5 is similar to that of the second pixel P4, which will not be described repeatedly.

For example, an acquisition unit for acquiring compensation data may be provided, and the compensation data of i pixels adjacent to the target pixel of the display panel may be acquired by the acquisition unit; for example, the acquisition unit may be implemented by a central processing unit (CPU), a Field Programmable Gate Array (FPGA) or other forms of processing units having data processing capabilities and/or instruction execution capabilities and corresponding computer instructions. The processing unit may be a general-purpose processor or a special-purpose processor, and may be a processor based on the X86 or ARM architecture.

For step S120, for example, the deviation data may include a maximum value, a minimum value, or a value that is greatly different from other data in the compensation data of all pixels. For example, in step S120, the compensation data of i pixels may be sorted first, and the maximum and minimum values in the compensation data of i pixels may be deleted, so as to calculate the compensation data of the target pixel according to the respective remaining compensation data. In the display compensation method provided by some embodiments of the present disclosure, by deleting deviation data from the compensation data of i pixels, the influence of the deviation data on the compensation data of the target pixel is avoided, so that the compensation data of the target pixel can be calculated based on respective compensation data having a smaller error in the compensation data of i pixels, so that the acquired compensation data of the target pixel is more accurate, thereby achieving a better compensation effect.

For example, as shown in FIG. 4A, in another example, steps S101 and S102 are further included before step S120.

Step S101: Determine whether a deviation data is included in the compensation data of i pixels, and if yes, perform step S120; if not, perform step S102.

For example, in one example, if the compensation data of i pixels are all equal, there is no deviation data. For example, other situations where there is no deviation data may also be included, which may depend on specific situations and is not limited in the embodiments of the present disclosure.

For example, according to the above description, it is determined whether the compensation data of i pixels includes a deviation data. If the deviation data is included, step S120 is performed, that is, the deviation data in the compensation data of i pixels is deleted; if the deviation data is not included, step S102, is performed, that is, the compensation data of the target pixel is directly calculated.

Step S102: Calculate the compensation data of the target pixel according to the compensation data of i pixels.

For example, the specific implementation process of this step is similar to that of step S130, which will be described in detail below, and will not be repeated here.

For example, a data selection unit for selecting data may be provided, and the deviation data in the compensation data of i pixels may be deleted by the data selection unit; for example, the data selection unit may be implemented by a central processing unit (CPU), a Field Programmable Gate Array (FPGA) or other form of processing unit with data processing capability and/or instruction execution capability and corresponding computer instructions.

For step S130, for example, the compensation data of the target pixel may be calculated based on the respective remaining compensation data. For example, in one example, the compensation data of i pixels adjacent to the target pixel is sorted to obtain a sequence from small to large or from large to small, and then the maximum and minimum values in the sequence are deleted, and the intermediate value is selected from the remaining data in the sequence, to calculate or to be used as the compensation data of the target pixel.

Figure 6:
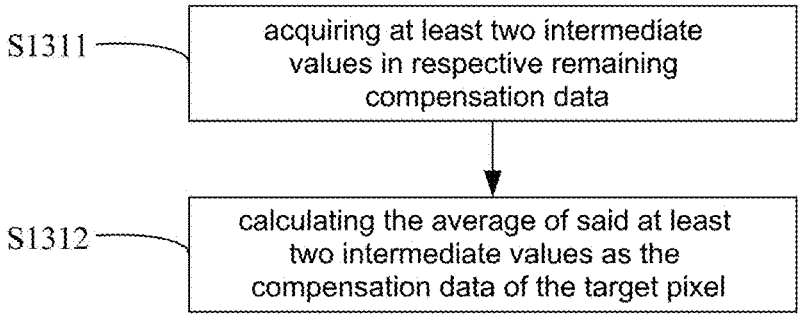
FIG. 6 is a flowchart of an example of step S130 shown in FIG. 4A.

FIG. 6 is a flowchart of an example of acquiring compensation data of the target pixel according to the acquired intermediate value of the remaining compensation data. That is, FIG. 6 is a flowchart of an example of step S130 shown in FIG. 4A. For example, in the example shown in FIG. 6, the method for acquiring the compensation data of the target pixel includes steps S1311 to S1312. Hereinafter, a display compensation method according to an embodiment of the present disclosure will be described with reference to FIG. 6.

Step S1311: Acquire at least two intermediate values in the respective remaining compensation data.

For example, the intermediate value indicates a value located in the middle of the above-mentioned sequence. For example, as shown in FIG. 4B and FIG. 4C, eight pixels P1-P8 around the target pixel A are selected. For example, the compensation data of the first pixel in the eight pixels P1-P8 can be obtained through the sensing elements comprised therein and subsequent related algorithm, and the compensation data of the second pixel may be obtained according to step S112. For example, in the embodiment shown in FIG. 4B, the compensation data of respective second pixel such as the second pixel P1 and the second pixel P3 may also be calculated according to the display compensation method of the present disclosure, which is not limited in the embodiment of the present disclosure.

For example, after arranging the acquired compensation data of the eight pixels P1-P8, a sequence from small to large: {100, 350, 360, 365, 370, 380, 390, 800} is obtained. For example, after deleting the minimum value of 100 and the maximum value of 800 from the sequence, at least two intermediate values in the respective remaining compensation data {350, 360, 365, 370, 380, 390} are extracted, for example, 365 and 370, so as to calculate the compensation data of the target pixel. It should be noted that more intermediate values may be acquired, for example, 360, 365, 370, and 380, which are not limited in the embodiments of the present disclosure.

It should be noted that the above-mentioned compensation data {100, 350, 360, 365, 370, 380, 390, 800} is set as an example for easy understanding and is only exemplary. The specific value thereof may depend on the specific situation, which is not limited in the embodiment of the present disclosure.

Step S1312: Calculate the average value of at least two intermediate values as the compensation data of the target pixel.

For example, the average value of at least two intermediate values (365+370)/2=367.5 is calculated as the compensation data of the target pixel and is stored.

For example, when the number of remaining compensation data is odd, an intermediate value may be selected as the compensation data of the target pixel, or an intermediate value and an average value of two values immediately adjacent to the intermediate value (that is, an average value of three numerical values) may be selected as the compensation data of the target pixel, which is not limited in the embodiments of the present disclosure.

Figure 7:
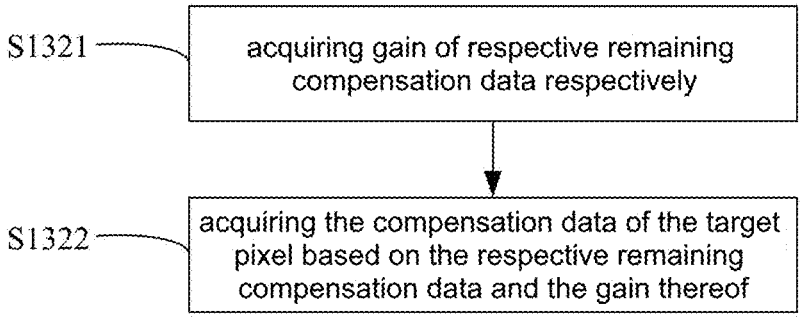
FIG. 7 is a flowchart of another example of step S130 shown in FIG. 4A.

For example, in another example, the compensation data of the target pixel may be calculated in a proportional gain manner. FIG. 7 is a flowchart of an example of calculating compensation data of a target pixel in a proportional gain (weight) manner according to some embodiments of the present disclosure. That is, FIG. 7 is a flowchart of another example of step S130 shown in FIG. 4A. For example, in the example shown in FIG. 7, the method for acquiring the compensation data of the target pixel includes steps S1321 to S1322. Hereinafter, a display compensation method according to an embodiment of the present disclosure will be described with reference to FIG. 7.

Step S1321: Acquire the gain of the respective remaining compensation data.

For example, the pixels corresponding to the respective remaining compensation data include: a plurality of first pixels including a sensing element (such as pixels P2, P4, P5, and P7 in FIG. 4B) and a plurality of second pixels including no sensing element (such as pixels P1, P3, P6, P8 in FIG. 4B). Since the compensation data of the first pixel is directly obtained through the sensing element and subsequent related algorithms, which is relatively accurate, and the compensation data of the second pixel is acquired indirectly through methods such as step S112, the absolute value of the gain of the compensation data of the first pixel may be set to be greater than the absolute value of the gain of the compensation data of the second pixel, and the absolute value of the gain of the compensation data of the second pixel that is closer to the first pixel may be set higher.

For example, based on the description in step S1311, the obtained compensation data of the eight pixels P1-P8 is arranged to obtain a sequence: {100, 350, 360, 365, 370, 380, 390, 800}. For example, after deleting the minimum value of 100 and the maximum value of 800 in the sequence, according to the above description related to the gain setting, the gains sequentially corresponding to the respective remaining compensation data {350, 360, 365, 370, 380, 390} can be set to {0.1, 0.1, 0.3, 0.1, 0.3, 0.1}, the sum of these gains is 1.

It should be noted that the above compensation data {100, 350, 360, 365, 370, 380, 390, 800} and their gains {0.1, 0.1, 0.3, 0.1, 0.3, 0.1} are set as examples for easy understanding, which is only exemplary. Specific numerical values may depend on specific situations, which is not limited in the embodiment of the present disclosure.

Step S1322: Acquire compensation data of the target pixel based on the respective remaining compensation data and its gain.

For example, the remaining compensation data and its corresponding gain are weighted and averaged, to acquire the compensation data of the target pixel and store it. For example, based on the data of the above example, the specific calculation process of the compensation data of the target pixel is as follows:

$$350*0.1+360*0.1+365*0.3+370*0.1+380*0.3+390*0.1=370.5$$

That is, the compensation data of the target pixel is 370.5.

For example, the calculation method of the compensation data of the target pixel shown in FIG. 6 and FIG. 7 does not need to store all the compensation data of the first pixel and the second pixel in advance, and can also be performed in real time as needed, thereby saving the storage space of the display panel, avoiding the display picture abnormality, etc. caused by the aging of the light emitting device, and improving display uniformity of the display panel.

For example, a calculation unit for calculating the compensation data may be provided, and the calculation data of the target pixel may be calculated by the calculation unit based on each remaining compensation data; for example, the computing unit may be implemented by a central processing unit (CPU), a Field Programmable Gate Array (FPGA) or other form of processing unit with data processing capability and/or instruction execution capability and corresponding computer instructions.

It should be noted that the flow of the display compensation method provided by some embodiments of the present disclosure may include more or fewer operations, and these operations may be performed sequentially or in parallel.

Although the flow of the display compensation method described above includes multiple operations occurring in a particular order, it should be clearly understood that the order of the multiple operations is not limited. The display compensation method described above may be executed once or multiple times according to a predetermined condition.

On the one hand, the display compensation method provided by some embodiments of the present disclosure can store only the compensation data of the first pixel, thereby saving storage space; on the other hand, in the display compensation method, the compensation data of the second pixel can be calculated in real time based on the compensation data of the first pixel. Therefore, it is possible to ensure the real-time sensing and compensation of the optical data of each pixel of the display panel, to avoid the display picture abnormality caused by the aging of the light emitting device, and to improve the display uniformity of the display panel.

Figure 8:
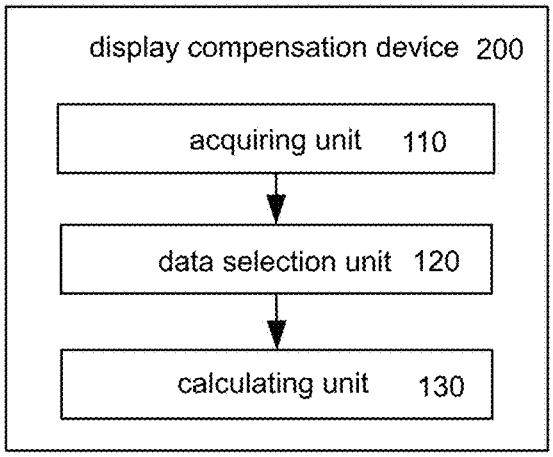
FIG. 8 is a schematic block diagram of a display compensation device according to some embodiments of the present disclosure.

FIG. 8 is a schematic block diagram of a display compensation device according to some embodiments of the present disclosure. For example, in the example shown in FIG. 8, the display compensation device 100 includes an acquisition unit 110, a data selection unit 120, and a calculation unit 130. For example, these units may be implemented in the form of hardware (eg., circuit) modules or software modules and any combination thereof.

The acquiring unit 110 is configured to acquire compensation data of i pixels adjacent to a target pixel of the display panel, respectively. For example, the acquiring unit 110 may implement step S110. For a specific implementation method, reference may be made to the related description of step S110, and details are not described herein again.

The data selection unit 120 is configured to delete deviation data from the compensation data of i pixels. For example, the data selection unit 120 may implement step S120. For a specific implementation method, reference may be made to the related description of step S120, and details are not described herein again.

The calculation unit 130 is configured to calculate the compensation data of the target pixel based on the respective remaining compensation data. For example, the calculation unit 130 may implement step S130. For a specific implementation method, reference may be made to the related description of step S130, and details are not described herein again.

It should be noted that the display compensation device provided by the embodiments of the present disclosure may include more or fewer circuits or units, and the connection relationship between the circuits or units is not limited, and may be determined according to actual needs. The specific construction of each circuit is not limited, and according to the circuit principle, may be composed of an analog device, a digital chip, or other applicable means.

Figure 9:
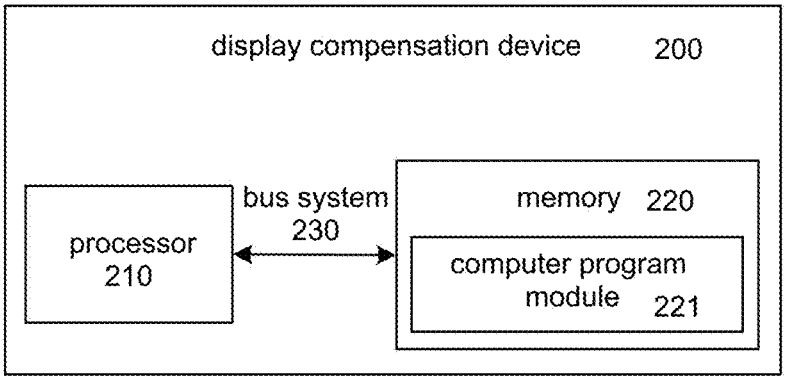
FIG. 9 is a schematic block diagram of another display compensation device according to some embodiments of the present disclosure.

FIG. 9 is a schematic block diagram of another display compensation device according to some embodiments of the present disclosure. As shown in FIG. 9, the display compensation device 200 includes a processor 210, a memory 220, and one or more computer program modules 221.

For example, the processor 210 and the memory 220 are connected through a bus system 230. For example, one or more computer program modules 221 are stored in the memory 220. For example, one or more computer program modules 221 include instructions for executing a display compensation method provided by any embodiment of the present disclosure. For example, the instructions in one or more of the computer program modules 221 may be executed by the processor 210. For example, the bus system 230 may be a commonly used serial or parallel communication bus, and the embodiments of the present disclosure are not limited thereto.

For example, the processor 210 may be a central processing unit (CPU), a Field Programmable Gate Array (FPGA), or other forms of processing units having data processing capabilities and/or instruction execution capabilities, which may be a general-purpose processor or a special-purpose processor, and may control other components in the display compensation device 200 to perform a desired function.

The memory 220 may include one or more computer program products, which may include various forms of computer-readable storage media, such as volatile memory and/or non-volatile memory. The volatile memory may include, for example, a random access memory (RAM) and/or a cache memory. The non-volatile memory may include, for example, a read-only memory (ROM), a hard disk, a flash memory, and the like. One or more computer program instructions may be stored on a computer-readable storage medium, and the processor 210 may run the program instructions to implement the functions in the embodiments of the present disclosure (implemented by the processor 210) and/or other desired functions, such as the display compensation method. The computer-readable storage medium may also store various applications and various data, such as compensation data for i pixels and various data used and/or generated by the application.

It should be noted that, for clarity and conciseness, the embodiments of the present disclosure do not provide all constituent units of the display compensation device 200. In order to realize the necessary functions of the display compensation device 200, those skilled in the art may provide and set other not-shown constituent units according to specific needs, which is not limited in the embodiments of the present disclosure.

Regarding the technical effects of the display compensation device 100 and the display compensation device 200 in different embodiments, reference may be made to the technical effects of the display compensation method provided by the embodiments of the present disclosure, and details are not repeated here.

Figure 10:
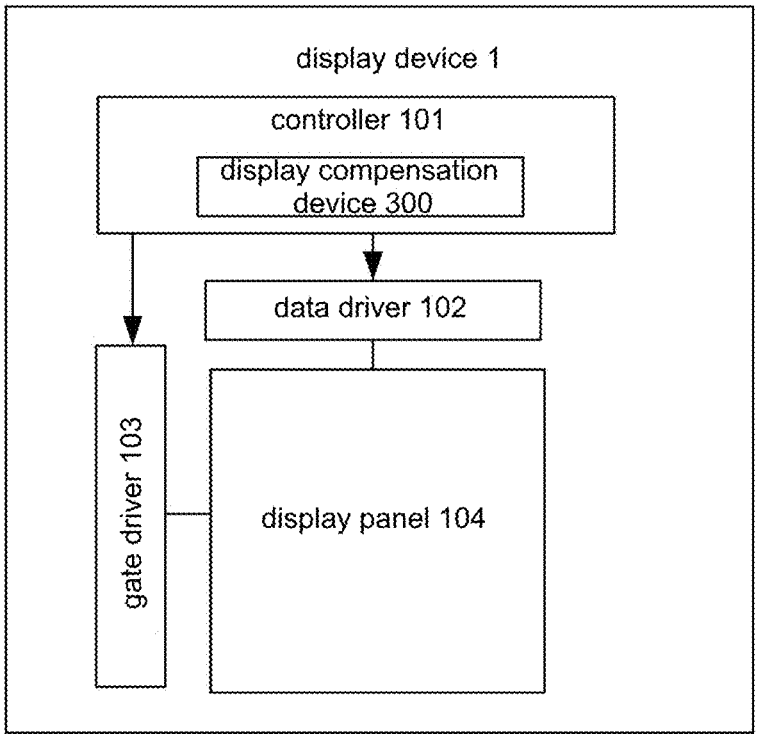
FIG. 10 is a schematic block diagram of a display panel according to some embodiments of the present disclosure.

At least one embodiment of the present disclosure also provides a display panel including a display compensation device provided by any embodiment of the present disclosure. FIG. 10 is a schematic block diagram of a display device provided by some embodiments of the present disclosure. As shown in FIG. 10, the display device 1 includes a display panel 104. The display panel 104 includes a display compensation device 300 provided by any embodiment of the present disclosure. For example, the display compensation device 300 may be the display compensation device 100 shown in FIG. 8 or the display compensation device 200 shown in FIG. 9. For example, the display compensation device 300 may be integrated on the display panel 104, which is not limited in the embodiment of the present disclosure.

As shown in FIG. 10, the display device 1 may further include a controller 101 (for example, a timing controller T-con), a data driver 102, and a gate driver 103. For example, the display compensation device 300 is provided in the controller 101 or integrated with the controller 101, and outputs the compensated display data signal to the data driver 102 under the control of the controller 101. For example, the controller 101, the gate driver 103, or the data driver 102 can all be integrated on the display panel 104, which is not limited in the embodiments of the present disclosure.

For example, the display panel 104 is configured to display an image. After the image data to be displayed is input to the display device 1, the input image data is compensated by the display compensation device 300, and then the display panel 104 adopts the compensated image data for display, thereby improving the display effect of the display panel, improving the display quality, and enhancing the display uniformity. For example, the display panel 104 may be an OLED display panel or a PLED display panel.

Figure 11B:
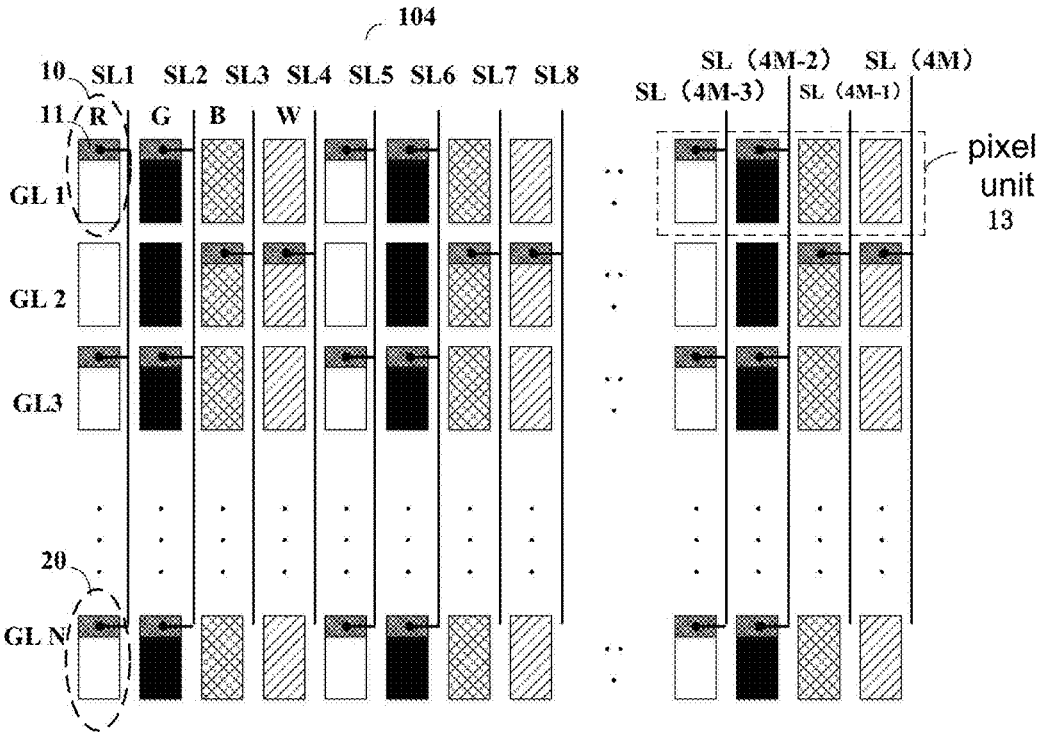
FIG. 11B is a schematic diagram of another display panel according to some embodiments of the present disclosure.
Figure 11C:
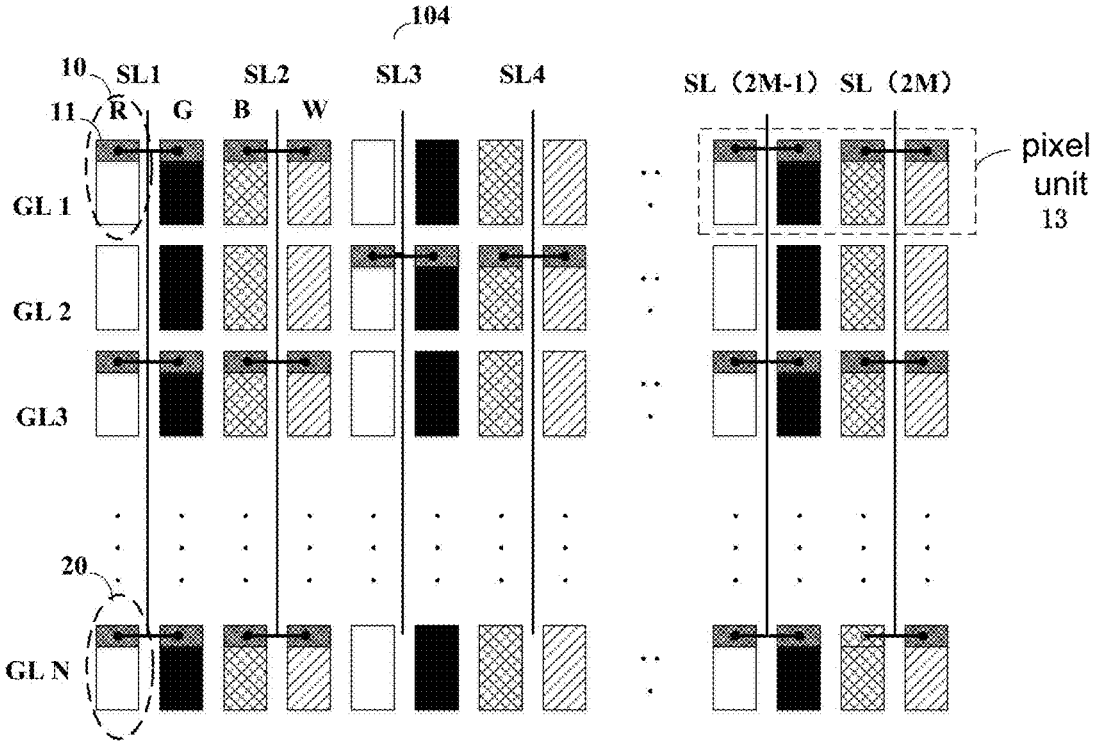
FIG. 11C is a schematic diagram of still another display panel according to some embodiments of the present disclosure.

FIG. 11A is a schematic diagram of a display panel provided by some embodiments of the present disclosure; FIG. 11B is a schematic diagram of another display panel provided by some embodiments of the present disclosure; FIG. 11C is still another display panel provided by some embodiments of the present disclosure 11D is a schematic diagram of still another display panel provided by some embodiments of the present disclosure.

For example, as shown in FIG. 11A, the display panel 104 includes a plurality of pixel units 13 arranged in an array. For example, each pixel unit 13 includes four-color pixels, which are a red pixel R, a green pixel G, a blue pixel B and a white pixels W in sequence. That is, the display panel 104 includes N rows and 4M columns of pixels. It should be noted that the embodiment of the present disclosure does not limit the composition of each pixel unit 13. For example, each pixel unit 13 may include a red pixel R, a green pixel G, and a blue pixel B without a white pixel W. For another example, each pixel unit may include a red pixel R, a green pixel G, a blue pixel B, a yellow pixel Y, and the like.

For example, the N rows and 4M columns of pixels include: a plurality of first pixels 10 including the sensing element 11 and a plurality of second pixels 20 including no sensing element 11. For example, the sensing element 11 may be a photodiode or a phototransistor, which is not limited in the embodiments of the present disclosure.

For example, as shown in FIG. 11A, the pixels in the N rows are connected to the N gate lines GL1-GLN in a one-to-one correspondence, respectively. It should be noted that, for the sake of clarity and conciseness, only the numbers of the gate lines are shown in FIG. 11A, and the specific connection lines are omitted, and the following embodiments are the same and will not be described again. For example, the sensing elements 11 of the first pixel 10 in the 4M column are respectively connected to the 4M sensing lines SL1-SL (4M) in a one-to-one correspondence, so that the amount of light sensed by the sensing elements 11 of each first pixel 10 (for example, the sensing value) is transmitted to the light sensing circuit described in FIG. 1 through a corresponding sensing line, and a compensation value is acquired through a corresponding algorithm.

For example, the first pixel 10 and the second pixel 20 may be arranged in a row-vertical staggered arrangement as shown in FIG. 11A or a row staggered arrangement, or a column staggered arrangement as shown in FIG. 11B, or may be arranged in other combinations. The embodiments of the present disclosure are not limited thereto. For example, in one example, the row staggered arrangement can be that the odd rows are the first pixels, the even rows are the second pixels, or the even rows are the first pixels, the odd rows are the second pixels, and of course, they can also be staggered every two rows, which is not limited in the embodiments of the present disclosure. For example, in one example, the column staggered arrangement may be that the odd columns are the first pixels, the even columns are the second pixels, or the even columns are the first pixels, and the odd columns are the second pixels, which is not limited in the embodiments of the present disclosure. For example, in one example, the row-vertical staggered arrangement may be, for example, that the first and second pixels shown in FIG. 11A are arranged at intervals on both rows and columns. In the display device provided by the embodiment of the present disclosure, the above-mentioned arrangement is adopted, that is, only part of pixels (for example, the first pixels) are integrated with the sensing element, thereby reducing the number of sensing elements, reducing the difficulty of designing the sensing element and weakening the influence of the sensing element on the pixel aperture ratio, and increasing the effective light-emitting area of the display panel.

Figure 11D:
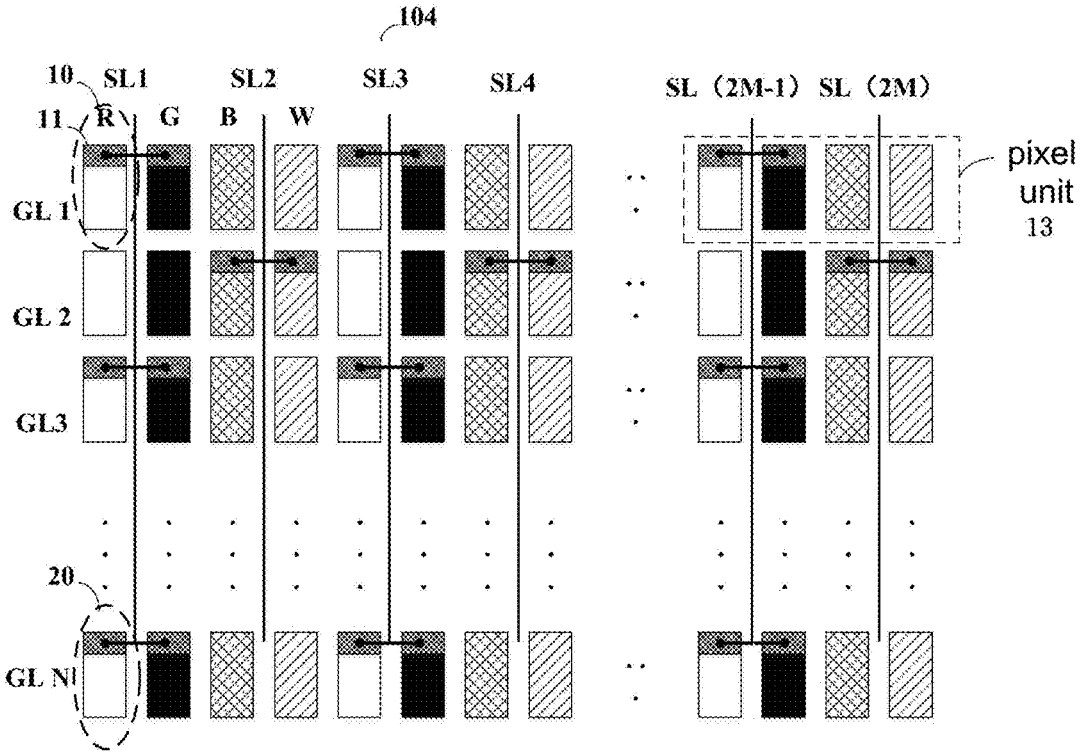
FIG. 11D is a schematic diagram of still another display panel according to some embodiments of the present disclosure.

For example, in the display device provided by the embodiment of the present disclosure, the sensing elements 11 of at least two columns of the first pixels 10 are connected through one sensing line. For example, as shown in FIG. 11C and FIG. 11D, each column of red pixels R and each column of green pixels G share one sensing line (for example, SL1, SL3 . . . SL (2M−1)), and each column of blue pixels B and each column of white pixels W share one sensing line (for example, SL2, SL4 . . . SL (2M)). It should be noted that the number of columns of the pixels sharing one sensing line can be freely combined, which is not limited in the embodiments of the present disclosure.

In the display device provided by the embodiments of the present disclosure, a plurality of columns of pixels share one sensing line, and the higher the proportion of the plurality of columns of pixels share one sensing line, the less the sensing line is required, so that the optimal design of the display panel can be realized and the cost of the display panel can be reduced.

For example, the optical characteristics of the light emitting device in the first pixel 10 may be sensed by the sensing element 11 in real time, and the optical characteristics (for example, sensing value or compensation value) of the second pixel 20 can be calculated in real time by using a plurality of pixels adjacent to the second pixel 20 (for example, the plurality of pixels include the first pixel 10 and the second pixel 20), so that the optical data can be sensed and compensated in real time according to the optical characteristics of each pixel, thus saving the storage space of the display panel, avoiding the phenomenon of abnormal display picture caused by aging of the light emitting device, and improving the display uniformity of the display panel.

For example, each pixel includes a driving circuit (not shown in the figure) and a light emitting device (not shown in the figure). For example, the driving circuit includes at least a driving transistor (not shown in the figure) and a switching transistor (not shown in the figure).

For example, the gate driver 103 is configured to be connected to the switching transistors of the pixels in the corresponding row through a plurality of gate lines, so as to provide a gate scanning signal for the switching transistors, thereby controlling the switching transistors to be turned on or off. For example, the gate driver 103 is connected to the controller 101 and is configured to generate a corresponding gate scanning signal by receiving signals such as a clock signal in the controller 101.

For example, the data driver 102 is configured to receive an output of the display compensation device 300 in the controller 101 and then provide an image data signal to the display panel 104. The image data signal is, for example, a compensated pixel voltage, and is configured to control the relative light emission intensity of the light emitting device of the corresponding pixel in the display so as to present a certain gray scale. For example, the higher the voltage of the image data signal is, the larger the gray scale is, thereby making the relative light emission intensity of the light emitting device greater. In addition, under different display brightness, the absolute brightness of light emission is different for each pixel even under the same gray scale. For example, according to the combination of different functional modules, the data driver 102 may include a digital driver and an analog driver. The analog driver receives red, green, and blue (RGB) analog signals, and then outputs the RGB analog signals to each pixel (ie., sub-pixel) via a thin film transistor; while the digital driver receives RGB digital signals, which are stored in the data driver 102 internally, subjected to D/A (digital/analog) conversion and gamma correction, converted to an analog signal and output to each pixel through a thin film transistor.

For example, the data driver 102 and the gate driver 103 may be implemented by respective application-specific integrated circuit chips or may be directly fabricated on the display panel 104 through a semiconductor fabrication process.

For technical effects of the display device 1 provided by some embodiments of the present disclosure, reference may be made to the corresponding descriptions of the display compensation method in the foregoing embodiments, and details are not described herein again.

Figure 12:
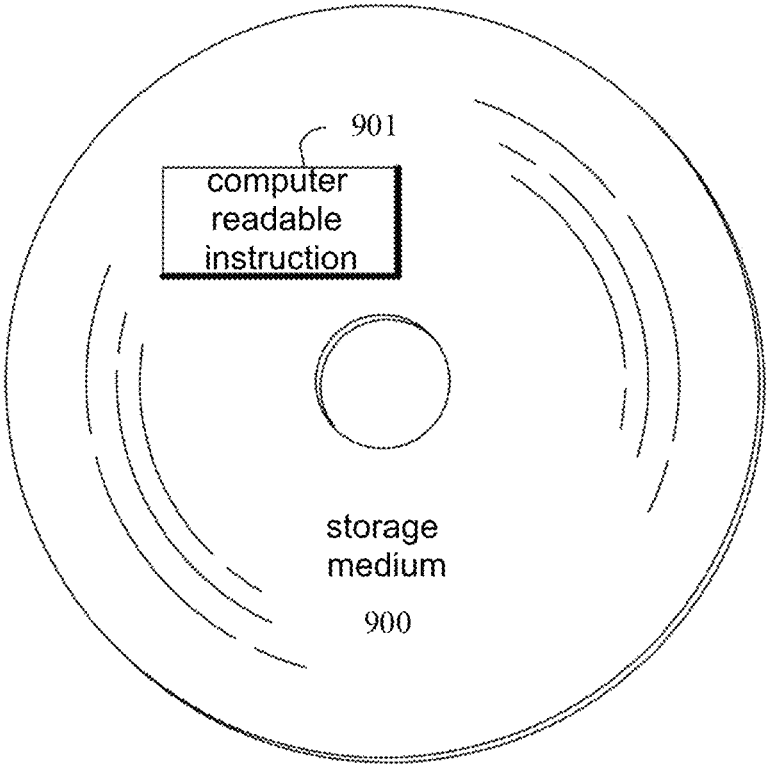
FIG. 12 is a schematic diagram of a storage medium according to some embodiments of the present disclosure.

Some embodiments of the present disclosure also provide a storage medium. FIG. 12 is a schematic diagram of a storage medium provided by some embodiments of the present disclosure. For example, the storage medium 900 stores computer-readable instructions 901 non-transitorily. When the non-transitory computer-readable instructions 901 are executed by a computer (including a processor), the display compensation method provided by any embodiment of the present disclosure may be executed.

For example, the storage medium may be any combination of one or more computer-readable storage media. For example, a computer-readable storage medium includes a computer-readable program code for acquiring compensation data of i pixels adjacent to a target pixel of a display panel, and another computer-readable storage medium contains a computer-readable program code for calculating compensation data of a target pixel based on the respective remaining compensation data. For example, when the program code is read by a computer, the computer may execute the program code stored in the computer storage medium to perform, for example, a display compensation method provided by any embodiment of the present disclosure.

For example, the storage medium may include a memory card of a smart phone, a storage part of a tablet computer, a hard disk of a personal computer, a random access memory (RAM), a read-only memory (ROM), an erasable programmable read-only memory (EPROM), a portable compact disc read-only memory (CD-ROM), flash memory, or any combination of the foregoing storage media, which may also be other applicable storage media.

For technical effects of the storage medium provided by the embodiments of the present disclosure, reference may be made to the corresponding description of the display compensation method in the foregoing embodiments, and details are not described herein again.

The following points need to be explained:

(1) The drawings of the embodiments of the present disclosure only relate to the structures related to the embodiments of the present disclosure. For other structures, reference may be made to the general design.

(2) In the case of no conflict, the embodiments of the present disclosure and features in the embodiments can be combined with each other to obtain a new embodiment.

What has been described above are merely exemplary embodiments of the present disclosure, and are not intended to limit the protection scope of the present disclosure, which is determined by the appended claims.

What is claimed is:

1. A display compensation method for a display panel, including:

acquiring compensation data of i pixels adjacent to a target pixel of the display panel respectively;

deleting deviation data from the compensation data of i pixels;

calculating the compensation data of the target pixel according to the respective remaining compensation data;

where i is an integer greater than two.

2. The display compensation method according to claim 1, wherein said i pixels include: a plurality of first pixels including a sensing element and a plurality of second pixels including no sensing element.

3. The display compensation method according to claim 1, wherein deleting a deviation data from the compensation data of i pixels comprises:

deleting a maximum value and a minimum value in the compensation data of i pixels.

4. The display compensation method according to claim 1, wherein calculating the compensation data of the target pixel according to the respective remaining compensation data comprises:

acquiring at least two intermediate values in the respective remaining compensation data;

calculating an average value of the at least two intermediate values as the compensation data of the target pixel.

5. The display compensation method according to claim 1, wherein calculating the compensation data of the target pixel according to the respective remaining compensation data comprises:

acquiring gains of the respective remaining compensation data respectively;

based on the respective remaining compensation data and the gains thereof, acquiring the compensation data of the target pixel.

6. The display compensation method according to claim 5, wherein the pixels corresponding to the respective remaining compensation data comprise: a plurality of first pixels including a sensing element and a plurality of second pixels including no sensing element, wherein, the absolute value of the gain of the compensation data of the first pixel is greater than the absolute value of the gain of the compensation data of the second pixel.

7. The display compensation method according to claim 2, wherein acquiring compensation data of i pixels adjacent to a target pixel of the display panel respectively comprises:

acquiring compensation data of the first pixel by the sensing element; and determining the compensation data of the second pixel according to the compensation data of the first pixel.

8. The display compensation method according to claim 7, wherein the compensation data of the second pixel is equal to the compensation data of the first pixel adjacent thereto, or equal to the average value of the compensation data of two first pixels adjacent thereto.

9. The display compensation method according to claim 7, wherein the compensation data of the first pixel is acquired by the sensing element in a time division manner.

10. The display compensation method according to claim 9, wherein the display panel includes a plurality of pixels arranged in an array, the plurality of pixels including: a plurality of first pixels including a sensing element and a plurality of second pixels including no sensing element, the plurality of pixels being configured to display a plurality of colors, wherein, acquiring the compensation data of the first pixel by the sensing element in a time division manner includes:

driving all pixels corresponding to the respective colors sequentially for display, and acquiring the compensation data of the first pixels corresponding to the respective colors sequentially by the sensing element.

11. The display compensation method according to claim 1, wherein the compensation data includes a sensing value or a compensation value.

12. A display compensation device, comprising:

an acquiring circuit configured to acquire compensation data of i pixels adjacent to a target pixel of the display panel respectively;

a data selection circuit configured to delete deviation data from the compensation data of i pixels;

a calculation circuit configured to calculate the compensation data of the target pixel according to the respective remaining compensation data;

wherein i is an integer greater than two.

13. A display panel comprising the display compensation device according to claim 12.

14. A display device comprising the display panel according to claim 13.

15. The display device according to claim 14, wherein the display panel includes a plurality of pixels arranged in an array, the plurality of pixels including: a plurality of first pixels including a sensing element and a plurality of second pixels including no sensing element, wherein, the first pixels and the second pixels are arranged in a row-vertical staggered arrangement, a row staggered arrangement, or a column staggered arrangement.

16. The display device according to claim 15, wherein the sensing elements of at least two columns of the first pixels are connected through one sensing line.

17. The display device according to claim 15, wherein the sensing element is a photodiode or a phototransistor.

18. A non-transitory storage medium that non-transitorily stores computer-readable instructions, wherein when the non-transitorily stored computer-readable instructions are executed by a computer, instructions for executing the display compensation method according to claim 1 are executed.

19. The display compensation device according to claim 12, wherein the data selection circuit is configured to delete a maximum value and a minimum value in the compensation data of i pixels.

* * * * *